US008939781B2

(12) United States Patent
Johnson

(10) Patent No.: US 8,939,781 B2
(45) Date of Patent: Jan. 27, 2015

(54) IMPLEMENTING RECONFIGURABLE POWER CONNECTOR FOR MULTIPLE WIRING CONFIGURATIONS

(71) Applicant: International Business Machines Corporation, Armonk, NY (US)

(72) Inventor: David B. Johnson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 154 days.

(21) Appl. No.: 13/664,584

(22) Filed: Oct. 31, 2012

(65) Prior Publication Data

US 2014/0120750 A1 May 1, 2014

(51) Int. Cl.
*H01R 29/00* (2006.01)

(52) U.S. Cl.
USPC ..... 439/171; 310/71

(58) Field of Classification Search
CPC ..... H01R 27/00; H01R 29/00; H01R 31/06; H01R 2103/00; H02K 3/522; H02K 5/225
USPC ..... 439/171–173, 956; 310/71
See application file for complete search history.

(56) References Cited

U.S. PATENT DOCUMENTS

| | | | | |
|---|---|---|---|---|
| 3,317,880 | A | 5/1967 | Meyer | |
| 4,781,610 | A * | 11/1988 | Mercer | 439/217 |
| 5,007,156 | A * | 4/1991 | Hurtgen | 29/596 |
| 5,017,818 | A * | 5/1991 | Dohogne | 310/71 |
| 5,295,845 | A | 3/1994 | Changxing | |
| 5,675,222 | A | 10/1997 | Fliege | |
| 6,048,219 | A * | 4/2000 | Kotowski | 439/221 |
| 6,062,884 | A | 5/2000 | Messimer et al. | |
| 6,139,341 | A | 10/2000 | Hun | |
| 6,419,504 | B1 | 7/2002 | Nelson | |
| 7,354,286 | B1 | 4/2008 | Lee | |
| 7,585,178 | B1 | 9/2009 | Abrahamsson et al. | |
| 7,602,137 | B2 | 10/2009 | Du et al. | |
| 7,931,473 | B2 * | 4/2011 | Watkins et al. | 439/49 |
| 7,982,145 | B2 | 7/2011 | Yuba et al. | |
| 8,283,831 | B1 * | 10/2012 | Kaminsky et al. | 310/198 |
| 8,513,843 | B2 * | 8/2013 | Kinugawa | 310/71 |
| 2010/0244598 | A1 | 9/2010 | Nass et al. | |
| 2011/0266900 | A1 | 11/2011 | Gaumer et al. | |
| 2012/0126647 | A1 | 5/2012 | Quero et al. | |

FOREIGN PATENT DOCUMENTS

| | | | |
|---|---|---|---|
| DE | 2700116 | A1 | 7/1978 |
| WO | 2011128177 | A1 | 10/2011 |

* cited by examiner

*Primary Examiner* — Thanh Tam Le
(74) *Attorney, Agent, or Firm* — Joan Pennington

(57) ABSTRACT

A method and structures are provided for implementing a reconfigurable power connector for multiple wiring configurations. The reconfigurable power connector optionally is configured to connect to either a 4-wire delta (Δ) or a 5-wire wye (Y). The reconfigurable power connector includes a fifth pin that is moveable between a retracted position in the 4-wire delta (Δ) configuration and an extended position in the 5-wire wye (Y) configuration.

18 Claims, 6 Drawing Sheets

IMPLEMENTING RECONFIGURABLE POWER CONNECTOR FOR MULTIPLE WIRING CONFIGURATIONS

FIELD OF THE INVENTION

The present invention relates generally to the data processing field, and more particularly, relates to a method and structures for implementing a reconfigurable power connector for multiple wiring configurations.

DESCRIPTION OF THE RELATED ART

Three-phase power connectors may come in a variety of configurations and sizes. At a high level three-phase power connectors could be lumped into two different categories: 4-wire delta configuration and 5-wire wye configuration. These different wiring configurations require a vendor to supply two different types of connectors.

A need exists for an effective method and structures for implementing a reconfigurable power connector for multiple wiring configurations. It is desirable to provide a hybrid, reconfigurable connector enabling either a 4-wire delta or a 5-wire wye configuration.

SUMMARY OF THE INVENTION

Principal aspects of the present invention are to provide a method and structures for implementing a reconfigurable power connector for multiple wiring configurations. Other important aspects of the present invention are to provide such method and structures substantially without negative effects and that overcome many of the disadvantages of prior art arrangements.

In brief, a method and structures are provided for implementing a reconfigurable power connector for multiple wiring configurations. The reconfigurable power connector includes a plurality of connector pins optionally configured to connect to either a 4-wire delta (Δ) or a 5-wire wye (Y). The reconfigurable power connector includes a fifth pin that is moveable between a retracted position in the 4-wire delta (Δ) configuration and an extended position in the 5-wire wye (Y) configuration.

In accordance with features of the invention, the housing is formed of a selected electrically insulative material having predefined rigidity and strength.

In accordance with features of the invention, the connector pins are formed of a selected electrically conductive material.

In accordance with features of the invention, the fifth pin provides a neutral connection in the 5-wire wye (Y) configuration.

In accordance with features of the invention, a lever is received within a slot formed in the connector housing for moving the fifth pin that is moveable between a retracted position in the 4-wire.

In accordance with features of the invention, the lever is formed of a selected electrically insulative material having predefined rigidity and strength, such as a selected plastic material.

In accordance with features of the invention, the reconfigurable power connector optionally includes a stop member, such as a one-way ratcheting locking stopper, to prevent changing a selected configuration.

In accordance with features of the invention, the reconfigurable power connector includes a configuration display indicating the selected 4-wire delta (Δ) or S-wire wye (Y) configuration for the reconfigurable power connector.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and structures are provided for implementing a reconfigurable power connector for multiple wiring configurations. The reconfigurable power connector optionally is configured to connect to either a 4-wire delta (Δ) or a 5-wire wye (Y). The reconfigurable power connector includes a fifth pin that is moveable between a retracted position in the 4-wire delta (Δ) configuration and an extended position in the 5-wire wye (Y) configuration.

Figure 1:
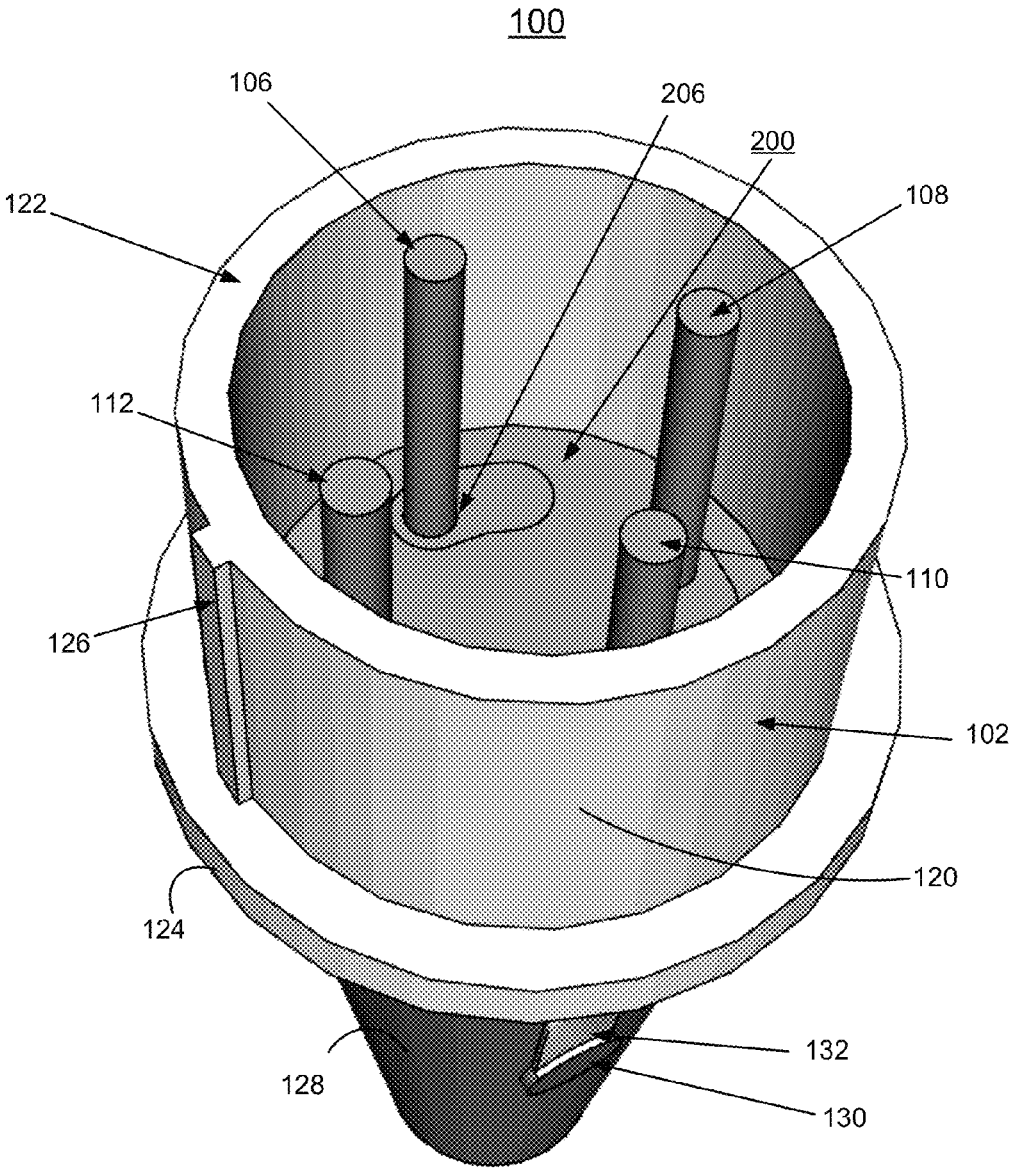
FIG. 1 is a perspective view not to scale illustrating an example reconfigurable power connector for implementing multiple wiring configurations provided in a 4-wire delta (Δ) configuration in accordance with the preferred embodiment.

Referring now to FIG. 1, there is schematically shown an example reconfigurable power connector generally designated by the reference character 100 in accordance with the preferred embodiment for implementing multiple wiring configurations, for example, as further illustrated and described with respect to FIGS. 2-5.

Referring to FIGS. 1-4, reconfigurable power connector 100 includes a connector housing generally designated by the reference character 102, and a plurality of connector pins 106, 108, 110, 112, and 114. As shown, the connector pins 106, 108, 110, 112, and 114 have a circular shape; however various shapes, such as blades can be used.

The connector housing 102 is formed of a selected electrically insulative material having predefined rigidity and strength, such as a selected plastic material. The connector pins 106, 108, 110, 112, and 114 are formed of a selected electrically conductive material, such as a copper alloy, beryllium copper or various other electrically conductive materials can be used, such as TiN, TaN, W, WN, Al, Cu, Ni, Co, Ru or a combination thereof.

The connector housing 102 includes an upper housing portion 120 receiving and positioning the connector pins 106, 108, 110, 112, and 114. The upper housing portion 120 includes an upper mating face 122 and an outwardly extending ledge or key for mating engagement with an associated connector or panel (not shown).

Figure 2:
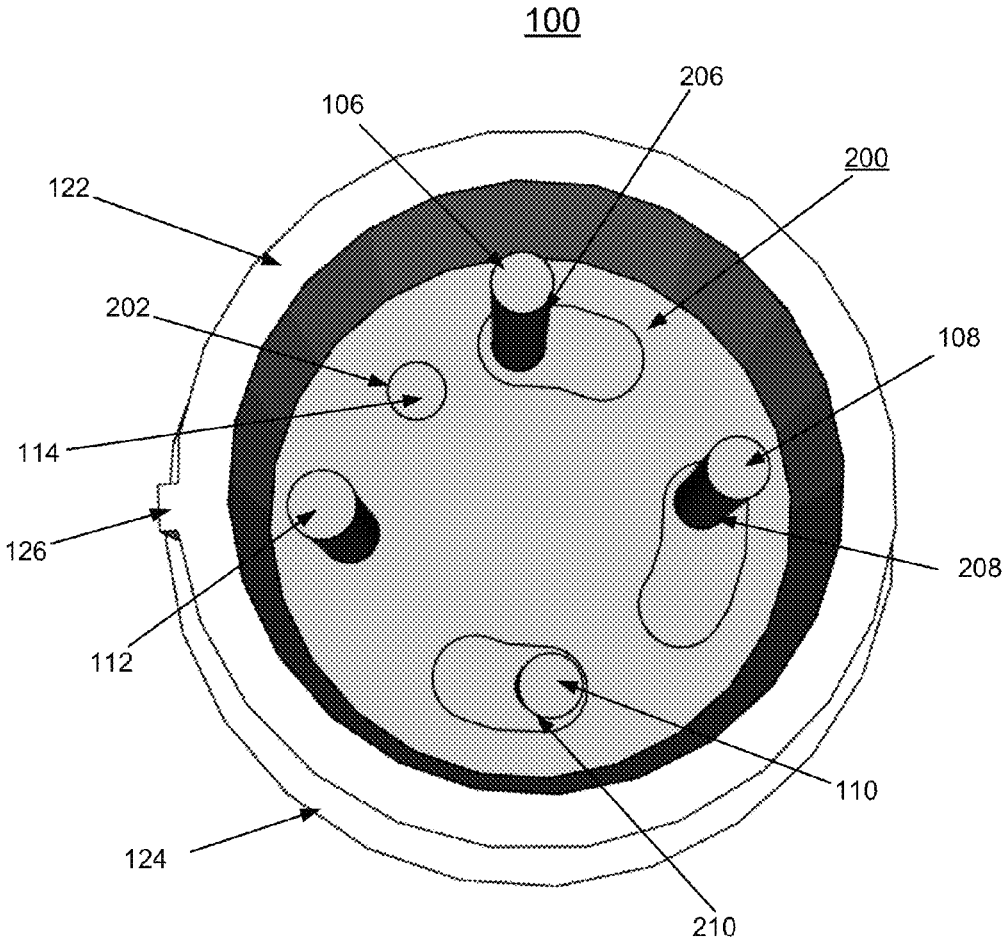
FIG. 2 is a perspective view not to scale schematically illustrating the reconfigurable power connector of FIG. 1 provided in the 4-wire delta (Δ) configuration in accordance with the preferred embodiment.
Figure 4:
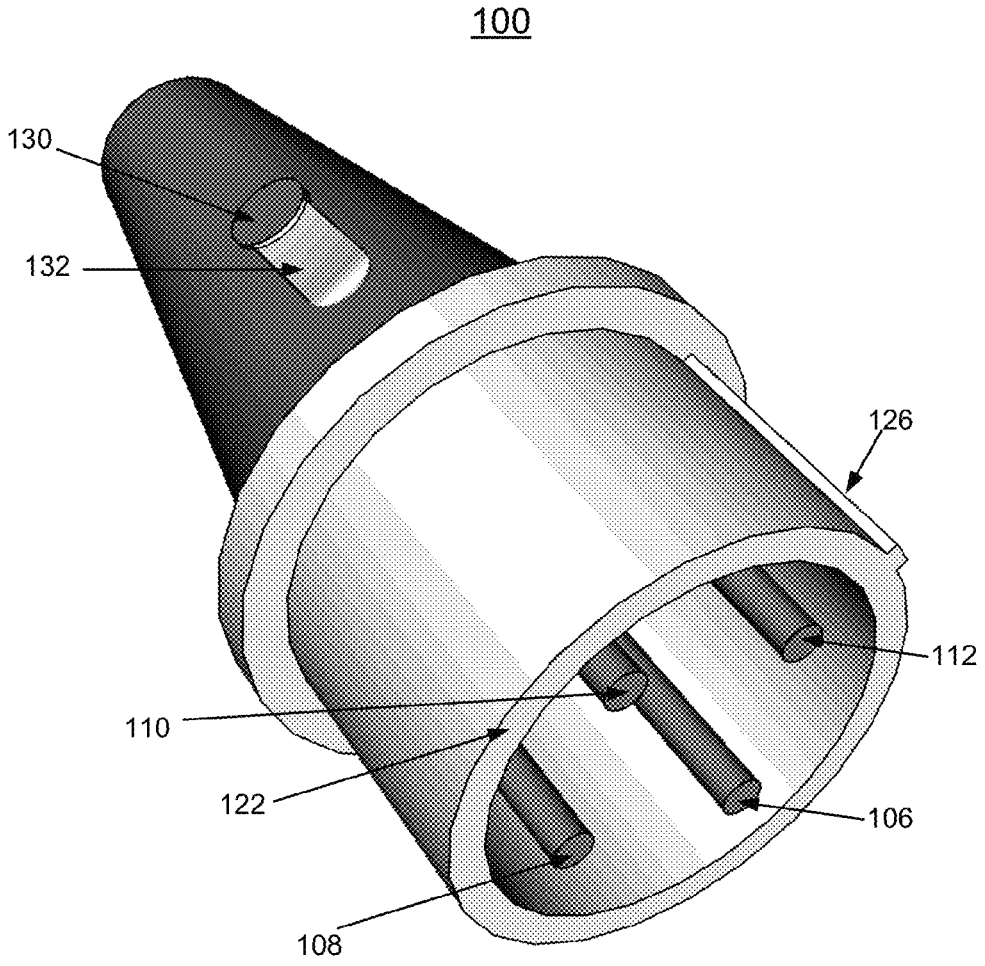
FIG. 4 is another perspective view not to scale schematically illustrating the reconfigurable power connector of FIG. 1 provided in the 4-wire delta (Δ) configuration in accordance with the preferred embodiment.

FIGS. 1, 2 and 4 illustrate the reconfigurable power connector 100 provided in a 4-wire delta (Δ) configuration generally designated by the reference character 200 in accordance with a preferred embodiment. The 4-wire delta (Δ) configuration 200 of the reconfigurable power connector 100 is best seen in FIG. 2.

Figure 3:
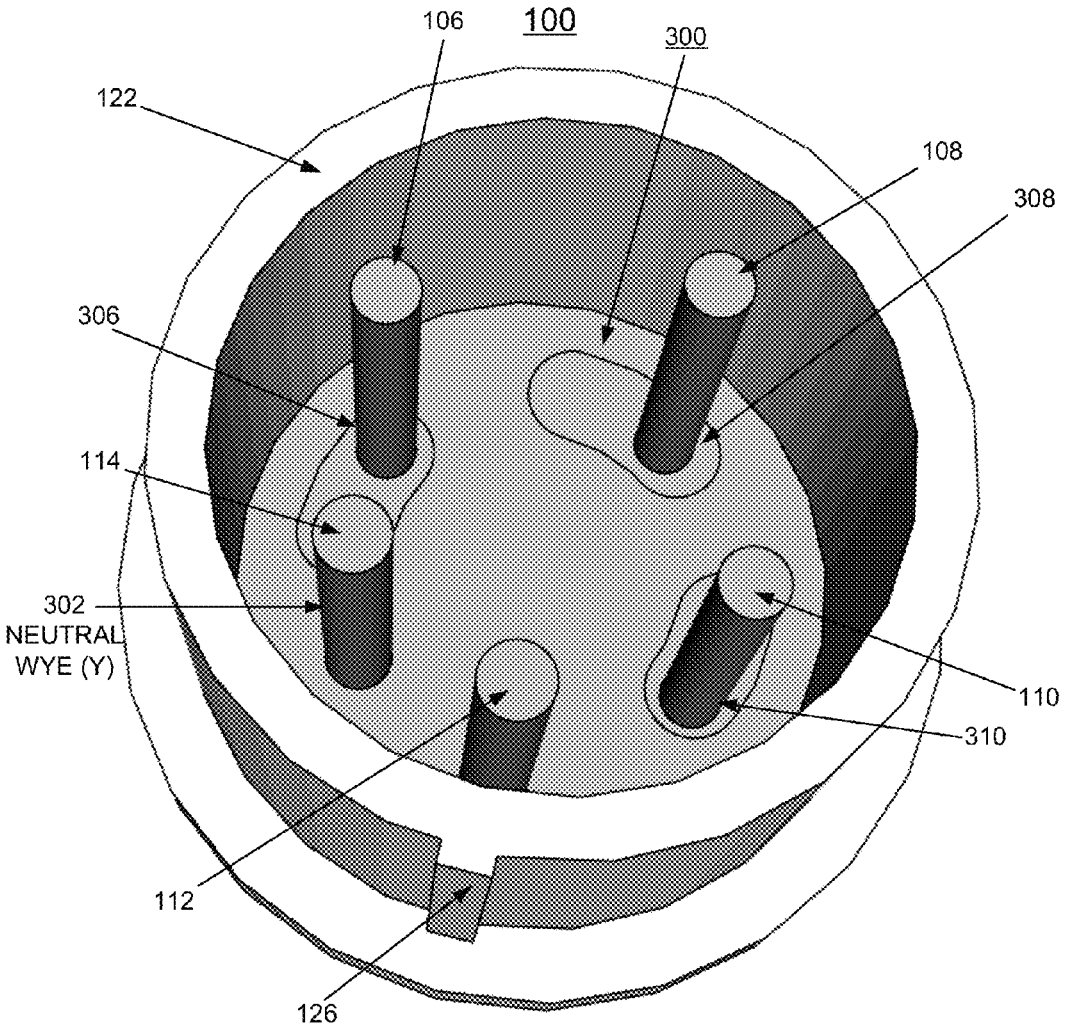
FIG. 3 is a perspective view not to scale schematically illustrating the reconfigurable power connector of FIG. 1 provided in a 5-wire wye (Y) configuration in accordance with the preferred embodiment.

FIG. 3 illustrates the reconfigurable power connector 100 provided in a 5-wire wye (Y) configuration generally designated by the reference character 300 in accordance with a preferred embodiment. A rotary movement provides the connector pins 106, 108, and 110 for the desired phase position 206, 208, 210 for the 4-wire delta (Δ) configuration 200 shown in FIG. 2 or the desired phase position 306, 308, 310 for the for the 5-wire wye (Y) configuration 300 shown in FIG. 3.

The fifth connector pin 114 is moveable between a retracted position 202 in the 4-wire delta (Δ) configuration 200 of the reconfigurable power connector 100 and an extended position 302 in the 5-wire wye (Y) configuration 300. As indicated in FIG. 3, the fifth connector pin 114 provides a neutral connection in the extended position 302 in the 5-wire wye (Y) configuration 300.

Referring now to FIG. 4, the connector housing 102 of the reconfigurable power connector 100 includes a lower housing portion 128. The reconfigurable power connector 100 includes a lever 130 for engaging and moving the fifth pin 114 between the retracted position 202 in the 4-wire delta (Δ) configuration 200 and the extended position 302 in the 5-wire wye (Y) configuration 300. As shown in FIGS. 2 and 4, the lever 130 is moved within a slot 132 provided within the connector housing 102 to provide the desired connector pin configuration of the 4-wire delta (Δ) configuration 200 or the 5-wire wye (Y) configuration 300. The lever 130 optionally can be removed to prevent the pin configuration from being changed in the future after the desired connector pin configuration of the 4-wire delta (Δ) configuration 200 or the 5-wire wye (Y) configuration 300 has been provided. The lever 130 is formed, for example, of a selected plastic material or other electrically insulative material having predefined rigidity and strength.

It should be understood that the present invention is not limited to the use of the illustrated lever 130; various other mechanisms can be used to move the retractable fifth pin 114. For example, the retractable fifth pin 114 could be moved in a rotary motion rather than the illustrated lever 130, and a lever could be mounted on the upper housing portion 120

Figure 5:
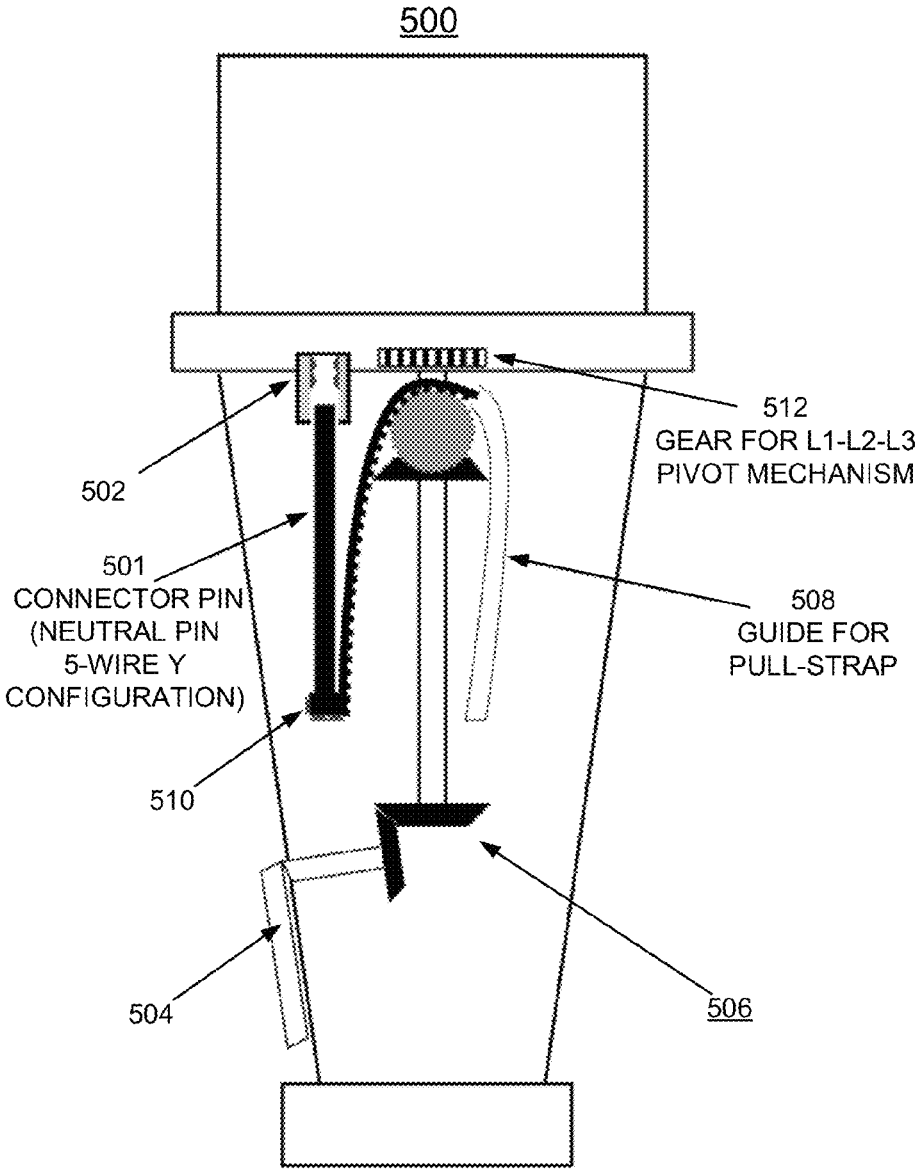
FIG. 5 is a side view not to scale schematically illustrating an example mechanism for configuring the reconfigurable power connector of FIG. 1 to connect to either a 4-wire delta (Δ) or a 5-wire wye (Y) in accordance with the preferred embodiment.

Referring now to FIG. 5, there is schematically illustrated an example mechanism generally designated by the reference character 500 for configuring the reconfigurable power connector 100 in either a 4-wire delta (Δ) or a 5-wire wye (Y) configuration in accordance with the preferred embodiment. Mechanism 500 can be used for moving a fifth retractable connector pin 501 providing a neutral pin for the 5-wire wye (Y) configuration. The fifth retractable connector pin 501 is moved upwardly through opening containing neutral contacts 502 providing a neutral connection in the extended position 302 in the 5-wire wye (Y) configuration 300 as shown in FIG. 3 for the reconfigurable power connector 100.

Mechanism 500 includes a lever 504 coupled to an lever function generally designated by the reference character 506 or multiple lever members 506 for selectively moving the fifth retractable connector pin 501. The lever members 506 also are coupled to a guide for pull-strap 508 and contacts 510 and the fifth retractable connector pin 501. Mechanism includes a gear 508 coupled to lever function members 506 providing L1, L2, L3 phase pivot movement or rotary movement providing the connector pins 106, 108, and 110 for the desired phase position 206, 208, 210 for the 4-wire delta (Δ) configuration 200 shown in FIG. 2 or the desired phase position 306, 308, 310 for the for the 5-wire wye (Y) configuration 300 shown in FIG. 3.

In accordance with features of the invention, the power connector 100 can be implemented to be reconfigurable between a 4-wire variety and a 5-wire in a permanent fashion prior to shipment to a customer, or it may be reconfigurable at the customer location.

Figure 6:
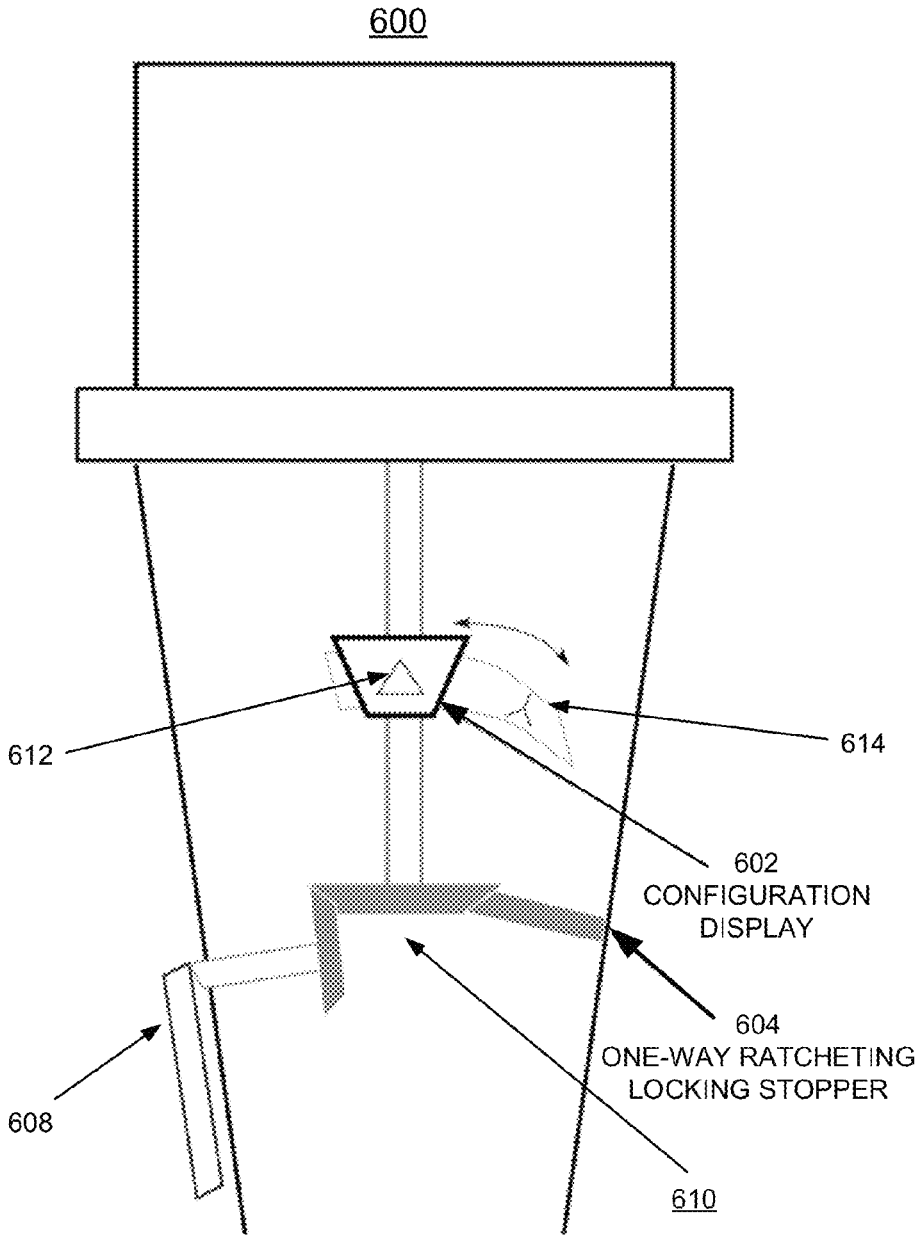
FIG. 6 is a side view not to scale schematically illustrating an example mechanism for configuring the reconfigurable power connector of FIG. 1 to connect to either a 4-wire delta (Δ) or a 5-wire wye (Y) including a configuration display and ratcheting locking stopper in accordance with the preferred embodiment.

Referring now to FIG. 6, there is schematically illustrated an example mechanism generally designated by the reference character 600 for configuring the reconfigurable power connector 100 in either a 4-wire delta (Δ) or a 5-wire wye (Y) configuration in accordance with the preferred embodiment. Mechanism 600 includes a configuration display 602 and a one-way ratcheting locking stopper 604 in accordance with the preferred embodiment. Mechanism 600 includes a lever 608 coupled to an lever function generally designated by the reference character 610 for moving the fifth pin (not shown in FIG. 6) between a retracted position in the 4-wire (Δ) or an extended position in the 5-wire wye (Y) configuration.

The one-way ratcheting locking stopper 604 of the reconfigurable power connector 100 is coupled to the lever function 610 functions as a stop member providing a one-way ratcheting locking stopper. The one-way ratcheting locking stopper 604 prevents further reconfiguration after the reconfigurable power connector 100 is configured to permanently set the state of the selected 4-wire delta (Δ) or a 5-wire wye (Y) configuration of the reconfigurable power connector.

The configuration display 602 of the reconfigurable power connector 100 100 is coupled to the lever function 610 having one position 612 indicating the selected 4-wire delta (Δ) and another position 614 indicating the selected 5-wire wye (Y) configuration for the reconfigurable power connector.

While the present invention has been described with reference to the details of the embodiments of the invention shown in the drawing, these details are not intended to limit the scope of the invention as claimed in the appended claims.

What is claimed is:

1. A structure for implementing a reconfigurable power connector for multiple wiring configurations comprising;

a connector housing;

a plurality of connector pins being selectively configured in a 4-wire delta (A) configuration and a 5-wire wye (Y) configuration;

said plurality of connector pins including a predefined pin moveable between a retracted position in the 4-wire delta (Δ) configuration and an extended position in the 5-wire wye (Y) configuration; and a lever adapted for moving said predefined pin.

2. The structure as recited in claim 1 wherein said predefined pin provides a neutral connection in said extended position in the 5-wire wye (Y) configuration; and a ratcheting locking stopper to permanently set a selected state of the 4-wire delta (Δ) configuration or the 5-wire wye (Y) configuration.

3. The structure as recited in claim 1 wherein said lever is adapted for moving said predefined pin from said retracted position in the 4-wire delta (Δ) configuration to said extended position in the 5-wire wye (Y) configuration.

4. The structure as recited in claim 1 wherein said lever is adapted for moving said predefined pin from said extended position in the 5-wire wye (Y) configuration to said retracted position in the 4-wire delta (Δ) configuration.

5. The structure as recited in claim 1 wherein said lever is received within a slot formed in said connector housing and said lever is formed of a selected electrically insulative material having predefined rigidity and strength.

6. The structure as recited in claim 1 wherein said lever is removed for preventing future configuration change.

7. The structure as recited in claim 1 includes a configuration window adapted for indicating a delta (Δ) configuration with said predefined pin in said retracted position and for indicating a wye (Y) configuration with said predefined pin in said extended position.

8. The structure as recited in claim 1 wherein said connector housing is formed of a selected electrically insulative material having predefined rigidity and strength.

9. The structure as recited in claim 1 wherein said plurality of connector pins are formed of a selected electrically conductive material.

10. The structure as recited in claim 1 wherein said plurality of connector pins include three predetermined connector pins having a first phase position for the 4-wire delta (Δ) configuration and having a second phase position for the 5-wire wye (Y) configuration.

11. The structure as recited in claim 1 wherein said plurality of connector pins being selectively configured in one of a 4-wire delta (Δ) configuration and a 5-wire wye (Y) configuration includes providing a rotary movement of predetermined connector pins for changing phase position for the 4-wire delta (Δ) configuration or for the 5-wire wye (Y) configuration.

12. A method for implementing a reconfigurable power connector for multiple wiring configurations comprising;

providing a connector housing;

providing a plurality of connector pins;

selectively said plurality of connector pins for phase position for a 4-wire delta (Δ) configuration and a 5-wire wye (Y) configuration;

moving a predefined pin to a retracted position for selectively configuring said plurality of connector pins in the 4-wire delta (A) configuration;

moving said predefined pin to an extended position for selectively configuring said plurality of connector pins in the 5-wire wye (Y) configuration; and providing a lever adapted for moving said predefined pin.

13. The method as recited in claim 12 wherein said predefined pin provides a neutral connection in said extended position in the 5-wire wye (Y) configuration.

14. The method as recited in claim 12 wherein selectively providing said plurality of connector pins for phase position for a 4-wire delta (Δ) configuration and a 5-wire wye (Y) configuration includes providing a rotary movement of predetermined connector pins for phase position for the 4-wire delta (Δ) configuration or for the 5-wire wye (Y) configuration.

15. The method as recited in claim 12 wherein providing said lever adapted for moving said predefined pin includes providing said lever adapted for moving said predefined pin formed of a selected electrically insulative material having predefined rigidity and strength.

16. The method as recited in claim 12 wherein providing said connector housing includes providing a connector housing formed of a selected electrically insulative material having predefined rigidity and strength.

17. The method as recited in claim 12 includes providing a configuration window adapted for indicating a delta (Δ) configuration with said predefined pin in said retracted position and for indicating a wye (Y) configuration with said predefined pin in said extended position.

18. The method as recited in claim 12 includes providing a ratcheting locking stopper to permanently set a selected state of the 4-wire delta (Δ) configuration or the 5-wire wye (Y) configuration.

* * * * *